US006992621B2

(12) United States Patent
Casas et al.

(10) Patent No.: US 6,992,621 B2
(45) Date of Patent: Jan. 31, 2006

(54) WIRELESS COMMUNICATION AND BEAM FORMING WITH PASSIVE BEAMFORMERS

(75) Inventors: Eduardo Casas, Vancouver (CA); Marcus da Silva, Spokane, WA (US)

(73) Assignee: Vivato, Inc., San Francisco, CA (US)

( * ) Notice: Subject to any disclaimer, the term of this patent is extended or adjusted under 35 U.S.C. 154(b) by 0 days.

(21) Appl. No.: 10/384,380

(22) Filed: Mar. 7, 2003

(65) Prior Publication Data

US 2004/0174299 A1 Sep. 9, 2004

(51) Int. Cl.
*H01Q 3/24* (2006.01)

(52) U.S. Cl. ..... 342/373; 342/374

(58) Field of Classification Search ..... 342/373, 342/374

See application file for complete search history.

(56) References Cited

U.S. PATENT DOCUMENTS 3,295,134 A * 12/1966 Lowe ..... 342/368
3,836,970 A * 9/1974 Reitzig ..... 342/373
3,858,218 A * 12/1974 Masak et al. ..... 342/406
4,231,040 A * 10/1980 Walker ..... 342/373
4,639,732 A * 1/1987 Acoraci et al. ..... 342/371
5,115,248 A * 5/1992 Roederer ..... 342/373
5,162,804 A * 11/1992 Uyeda ..... 342/373
5,610,617 A * 3/1997 Gans et al. ..... 342/373
5,666,123 A * 9/1997 Chrystie ..... 342/373
6,104,935 A * 8/2000 Smith et al. ..... 455/562.1
6,167,036 A * 12/2000 Beven ..... 455/440
6,252,544 B1 6/2001 Hoffberg
6,340,948 B1 1/2002 Munoz-Garcia et al.
6,353,410 B1 * 3/2002 Powell ..... 342/373
6,397,082 B1 * 5/2002 Searle ..... 455/562.1
6,429,812 B1 8/2002 Hoffberg
6,470,192 B1 * 10/2002 Karlsson et al. ..... 455/562.1
2001/0016504 A1 * 8/2001 Dam et al. ..... 455/562
2002/0163478 A1 * 11/2002 Pleva et al. ..... 343/853

OTHER PUBLICATIONS

P. Lehne et al., An Overview of Smart Antenna Technology for Mobile Communications Systems, IEEE Communications Surveys, vol. 2(4), p. 2-13, 1999.*

K. Uehara et al., A planar sector antenna for indoor high-speed wireless communication terminals, IEEE Antennas and Propagation Society International Symposium Digest, vol. 2, p. 1352-1355, Jul. 1997.*

F. Caldwell Jr. et al., Design and implementation of a switched-beam smart antenna for an 802.11b wireless access point, IEEE Radio and Wireless Conference, p. 55-58, Aug. 2002.*

(Continued)

*Primary Examiner*—Thomas H. Tarcza
*Assistant Examiner*—F H Mull
(74) *Attorney, Agent, or Firm*—Lee & Hayes, PLLC

(57) ABSTRACT

Wireless communication and beamforming is improved by depopulating one or more ports of a passive beamformer such as a Butler matrix and/or by increasing the order thereof. In an exemplary implementation, an access station includes: a Butler matrix having "M" antenna ports and "N" transmit and/or receive (TRX) ports; wherein at least a portion of the "M" antenna ports and/or at least a portion of the "N" TRX ports are depopulated. In another exemplary implementation, an access station includes: a Butler matrix that has multiple antenna ports and multiple TRX ports; a signal processor; and a signal selection device that is capable of coupling the signal processor to a subset of the multiple TRX ports responsive to a signal quality determination, the signal selection device adapted to switch the signal processor from a first TRX port to a second TRX port of the subset of TRX ports.

39 Claims, 10 Drawing Sheets

OTHER PUBLICATIONS

W.X. Sheng et al., Super-resolution DOA estimation in switch beam smart antenna, Proceedings of the 5th International Symposium on Antennas, Propagation and EM Theory, p. 603-606, Aug. 2000.*

M.V. Clark et al., Outdoor IEEE 802.11 cellular networks: radio link performance, IEEE International Conference on Communication, vol. 1, p. 512-516, 2002.*

* cited by examiner

WIRELESS COMMUNICATION AND BEAM FORMING WITH PASSIVE BEAMFORMERS

TECHNICAL FIELD

This disclosure relates in general to wireless communication and beam forming using passive beamformers and in particular, by way of example but not limitation, to improving at least one aspect of wireless communication by depopulating one or more ports of a passive beamformer and/or by increasing the order of a passive beamformer such as a Butler matrix.

BACKGROUND

In wireless communication, signals are sent from a transmitter to a receiver using electromagnetic waves that emanate from an antenna. These electromagnetic waves may be sent equally in all directions or focused in one or more desired directions. When the electromagnetic waves are focused in a desired direction, the pattern formed by the electromagnetic wave is termed a "beam" or "beam pattern." Hence, the production and/or application of such electromagnetic beams are typically referred to as "beamforming."

Beamforming may provide a number of benefits such as greater range and/or coverage per unit of transmitted power, improved resistance to interference, increased immunity to the deleterious effects of multipath transmission signals, and so forth. Beamforming can be achieved (i) using a finely tuned vector modulator to drive each antenna element to thereby arbitrarily form beam shapes, (ii) by implementing full adaptive beam forming, and (iii) by connecting a transmit/receive signal processor to each port of a Butler matrix.

A traditional Butler matrix is a passive device that forms beams of a pre-determined size and shape that emanate from an antenna array that is connected to the Butler matrix. The Butler matrix includes a first set of ports that connect to the antenna array and a second set of ports that connect to multiple transmit/receive signal processors. The first set of ports are denoted as antenna ports, and the second set of ports are denoted as transmit/receive ports. The number of ports in each of the first and second sets may be considered to determine the order of the Butler matrix. While not required, Butler matrices typically have an order that is a power of two, such as 4, 8, 16, 32, and so forth. In a conventional wireless communications environment, every port of the set of antenna ports of a Butler matrix is connected to an antenna element, and every port of the set of transmit/receive ports of a Butler matrix is connected to a signal processor.

By way of example, a Butler matrix may have an order of 16. In this case, there are 16 transmit/receive signal processors connected to the 16 transmit/receive ports of the Butler matrix, and there are 16 antenna elements connected to the 16 antenna ports of the Butler matrix. In operation, multiple individual beams of a fixed size and shape emanate from the antenna array. Signals transmitted in and received from each of the respective 16 beams map to a predetermined one of the 16 signal processors on the 16 transmit/receive ports of the Butler matrix. Thus, there is a one-to-one correspondence between (i) each beam formed by the combination of the Butler matrix and the antenna array and (ii) each signal processor that is connected to the Butler matrix.

Accordingly, there is a need for schemes and/or techniques for improving the variety and versatility of wireless communication and beamforming options.

SUMMARY

Improving at least one aspect of wireless communication and beamforming is enabled by depopulating one or more ports of a passive beamformer such as a Butler matrix and/or by increasing the order thereof. In conjunction with such depopulation, one or more signal selection schemes may be employed to select a transmit/receive (TRX) port for wireless communication from among multiple TRX ports of a passive beamformer.

In an exemplary described access station implementation, an access station for wireless communications includes: a Butler matrix that has "M" antenna ports and "N" TRX ports; wherein at least a portion of the "M" antenna ports and/or at least a portion of the "N" TRX ports are depopulated.

In another exemplary described access station implementation, an access station for wireless communications includes: a Butler matrix that has multiple antenna ports and multiple TRX ports; a signal processor; and a signal selection device that is capable of coupling the signal processor to a subset of the multiple TRX ports responsive to a signal quality determination, the signal selection device adapted to switch the signal processor from a first TRX port of the subset of TRX ports to a second TRX port of the subset of TRX ports.

In yet another exemplary described access station implementation, an access station for wireless communications includes: a passive beamformer having multiple antenna ports and multiple TRX ports; and an antenna array having multiple antenna elements that are coupled to at least a portion of the multiple antenna ports of the passive beamformer, the multiple TRX ports numbering more than the multiple antenna elements; wherein signals that are applied to the multiple TRX ports of the passive beamformer are transceived on multiple communication beams that are formed jointly by the passive beamformer and the antenna array, and wherein the access station is adapted to have an aiming resolution for communication beams of the multiple communication beams that is finer than a width of a narrowest communication beam of the multiple communication beams.

In an exemplary described method implementation, a method for an access station includes the actions of: comparing a first signal quality from a first communication beam to a second signal quality from a second communication beam; if the first signal quality is greater than the second signal quality, then transceiving from a first TRX port of a Butler matrix; and if the second signal quality is greater than the first signal quality, then transceiving from a second TRX port of the Butler matrix.

Other method, system, apparatus, access station, Butler matrix, arrangement, etc. implementations are described herein.

BRIEF DESCRIPTION OF THE DRAWINGS

The same numbers are used throughout the drawings to reference like and/or corresponding aspects, features, and components.

DETAILED DESCRIPTION

Figure 1:
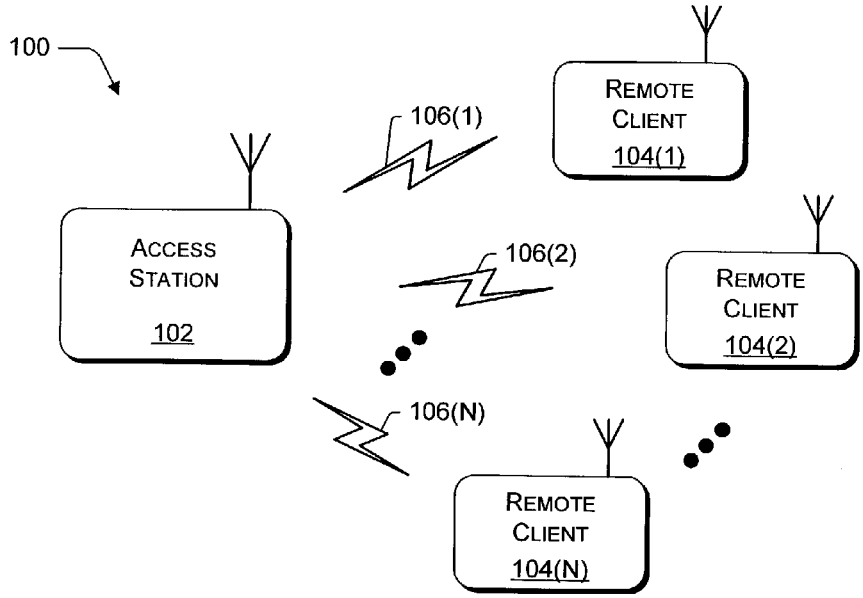
FIG. 1 is an exemplary general wireless communications environment.

FIG. 1 is an exemplary general wireless communications environment 100. Wireless communications environment 100 is representative generally of many different types of wireless communications environments, including but not limited to those pertaining to wireless local area networks (LANs) or wide area networks (WANs) (e.g., Wi-Fi) technology, cellular technology, trunking technology, and so forth. In wireless communications environment 100, an access station 102 is in wireless communication with remote clients 104(1), 104(2). . . 104(N) via communication links 106(1), 106(2). . . 106(N), respectively. Although not required, access station 102 is typically fixed, and remote clients 104 are typically mobile. Also, although only three remote clients 104 are shown, access station 102 may be in wireless communication with many such remote clients 104.

With respect to a Wi-Fi wireless communications system, access station 102 and/or remote clients 104 may operate in accordance with any IEEE 802.11 or similar standard. With respect to a cellular system, access station 102 and/or 11 remote clients 104 may operate in accordance with any analog or digital standard, including but not limited to those using time division/demand multiple access (TDMA), code division multiple access (CDMA), spread spectrum, some combination thereof, or any other such technology.

Access station 102 may be, for example, a nexus point, a trunking radio, a base station, a Wi-Fi switch, an access point, some combination and/or derivative thereof, and so forth. Remote clients 104 may be, for example, a hand-held device, a desktop or laptop computer, an expansion card or similar that is coupled to a desktop or laptop computer, a personal digital assistant (PDA), a car having a wireless communication device, a tablet or hand/palm-sized computer, a portable inventory-related scanning device, some combination thereof, and so forth. Remote clients 104 may operate in accordance with any standardized and/or specialized technology that is compatible with the operation of access station 102.

Figure 2:
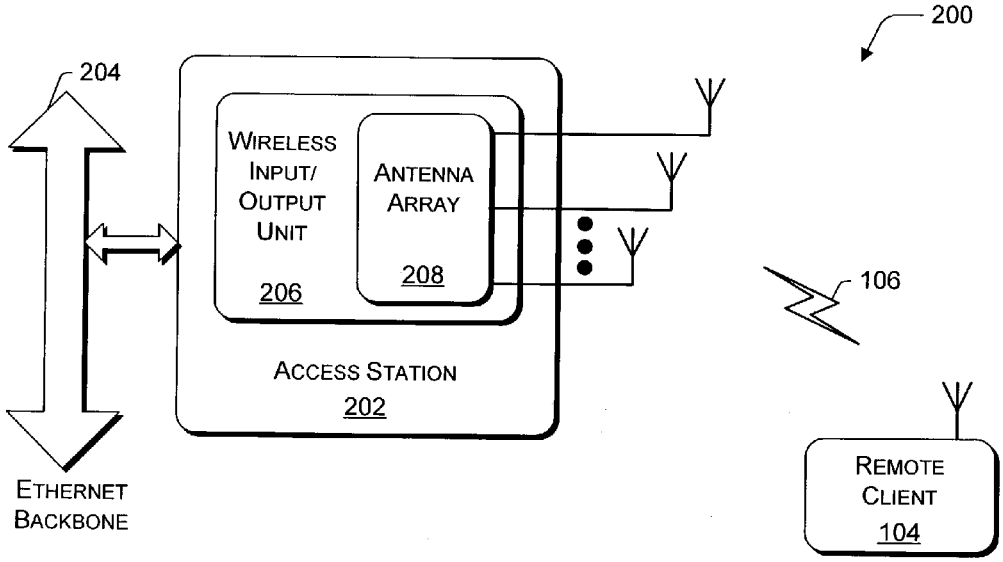
FIG. 2 is an exemplary wireless LAN/WAN (Wi-Fi)-specific wireless communications environment that includes a wireless input/output (I/O) unit.

FIG. 2 is an exemplary Wi-Fi-specific wireless communications environment 200 that includes a wireless input/output (I/O) unit 206. Exemplary access station 202 is an example of an access station 102 (of FIG. 1) that operates in accordance with a Wi-Fi-compatible or similar standard. Access station 202 is coupled to an Ethernet backbone 204. Access station 202, especially because it is illustrated as being directly coupled to Ethernet backbone 204 without an intervening Ethernet router or switch, may itself be considered a Wi-Fi switch.

Access station 202 includes wireless I/O unit 206. Wireless I/O unit 206 includes an antenna array 208 that is implemented as two or more antennas, and optionally as a phased array of antennas. Wireless I/O unit 206 is capable of transmitting and/or receiving (i.e., transceiving) wireless communication(s) 106 via antenna array 208. These wireless communication(s) 106 are transmitted to and received from (i.e., transceived with respect to) remote client 104.

Figure 3:
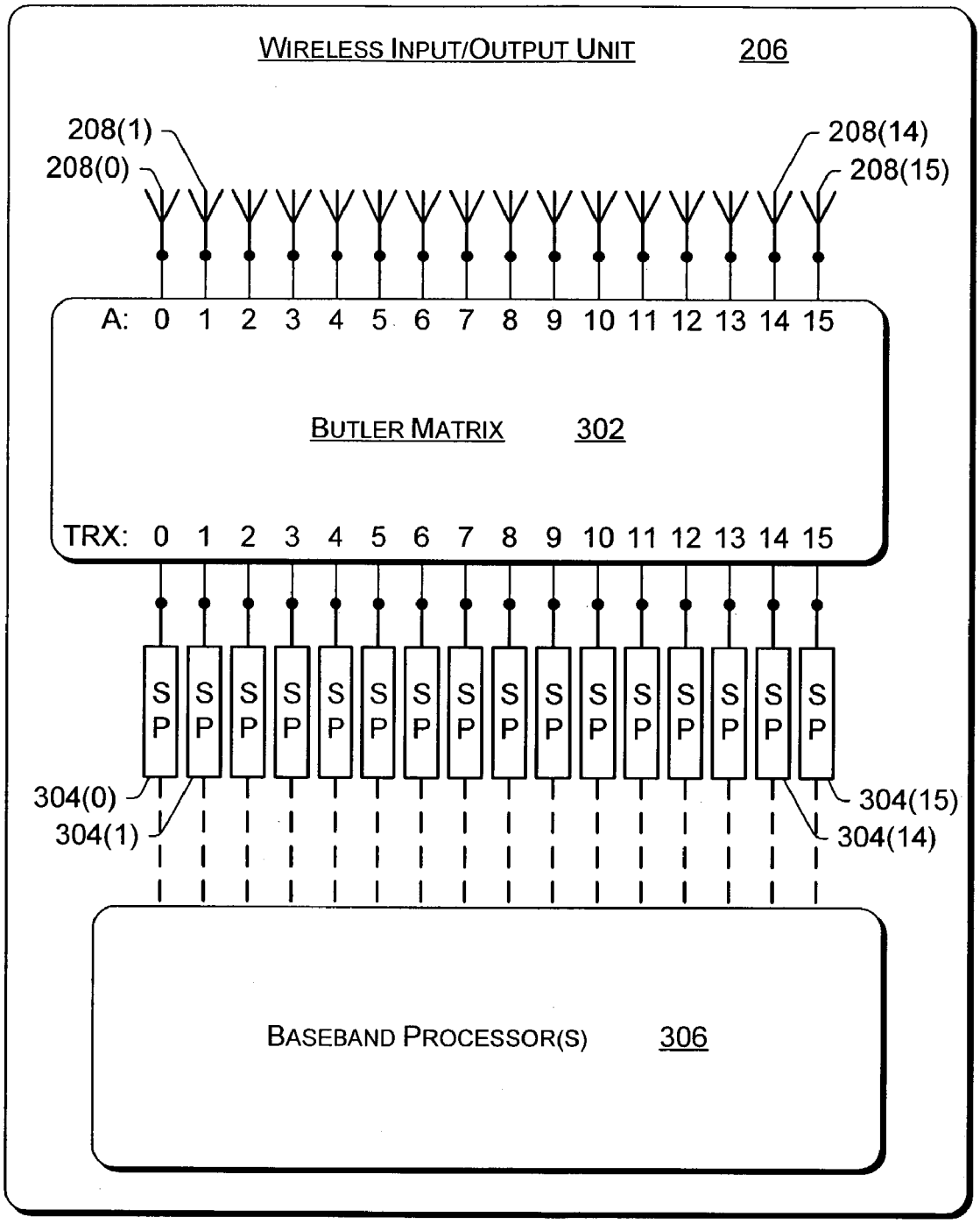
FIG. 3 is an exemplary wireless I/O unit as shown in FIG. 2 that includes a Butler matrix and an antenna array.

FIG. 3 is an exemplary wireless I/O unit 206 as shown in FIG. 2 that includes a Butler matrix 302 and an antenna array 208. Wireless I/O unit 206 also includes multiple signal processors (SPs) 304 and one or more baseband processors 306. Baseband processors 306 accept communication signals from and provide communication signals to the multiple transmit and receive signal processors 304. A separate baseband processor 306 may be assigned to each signal processor 304, or a single baseband processor 306 may be assigned to more than one, and up to all, of the multiple signal processors 304.

Exemplary Butler matrix 302 is a passive device that forms, in conjunction with antenna array 208, communication beams using signal combiners, signal splitters, and signal phase shifters. Butler matrix 302 includes a first side with multiple antenna ports (designated by "A") and a second side with multiple transmit and/or receive signal processor ports (designated by "TRX"). The number of antenna ports and TRX ports indicate the order of the Butler matrix. Butler matrix 302 includes 16 antenna ports and 16 TRX ports. Thus, Butler matrix 302 has an order of 16.

Although Butler matrix 302 is so illustrated, antenna ports and TRX ports need not be distributed on separate, much less opposite, sides of a Butler matrix. Also, although not necessary, Butler matrices usually have an equal number of antenna ports and transmit and/or receive signal processor ports (or TRX ports). Furthermore, although Butler matrices are typically of an order that is a power of two (e.g., 2, 4, 8, 16, 32, 64 . . . $2^n$), they may alternatively be implemented with any number of ports.

The sixteen antenna ports of Butler matrix 302 are numbered from 0 to 15. Likewise, the sixteen TRX ports are numbered from 0 to 15. Antenna ports 0, 1 . . . 14, and 15 are coupled to and populated with sixteen antennas 208(0), 208(1). 208(14), and 208(15), respectively. Likewise, TRX ports 0, 1 . . . 14, and 15 are coupled to and populated with sixteen signal processors 304(0), 304(1) . . . 304(14), and 304(15), respectively. These signal processors are also directly or indirectly coupled to baseband processors 306 as indicated by the dashed lines. It should be noted that one or more active components (e.g., a power amplifier (PA), a low-noise amplifier (LNA), etc.) may also be coupled on the antenna port side of Butler matrix 302.

In an exemplary transmission operation, communication signals are provided from baseband processors 306 to the multiple transmit and/or receive signal processors (SP) 304. The multiple signal processors 304 forward the communication signals to the TRX ports 0, 1 . . . 14, and 15 of Butler matrix 302. After signal combination, signal splitting, and signal phase shifting, Butler matrix 302 outputs communication signals on the antenna ports 0, 1 . . . 14, and 15.

Individual antennas 208 wirelessly transmit the communication signals, as altered by Butler matrix 302, from the antenna ports in predetermined beam patterns. The beam patterns are predetermined by the shape, orientation, constituency, etc. of antenna array 208 and by the alteration of the communication signals as "performed" by Butler matrix 302. In addition to transmissions, wireless signals such as wireless communications 106 (of FIGS. 1 and 2) are received responsive to the communication beams formed by antenna array 208 in conjunction with Butler matrix 302 in an inverse process.

Figure 4:
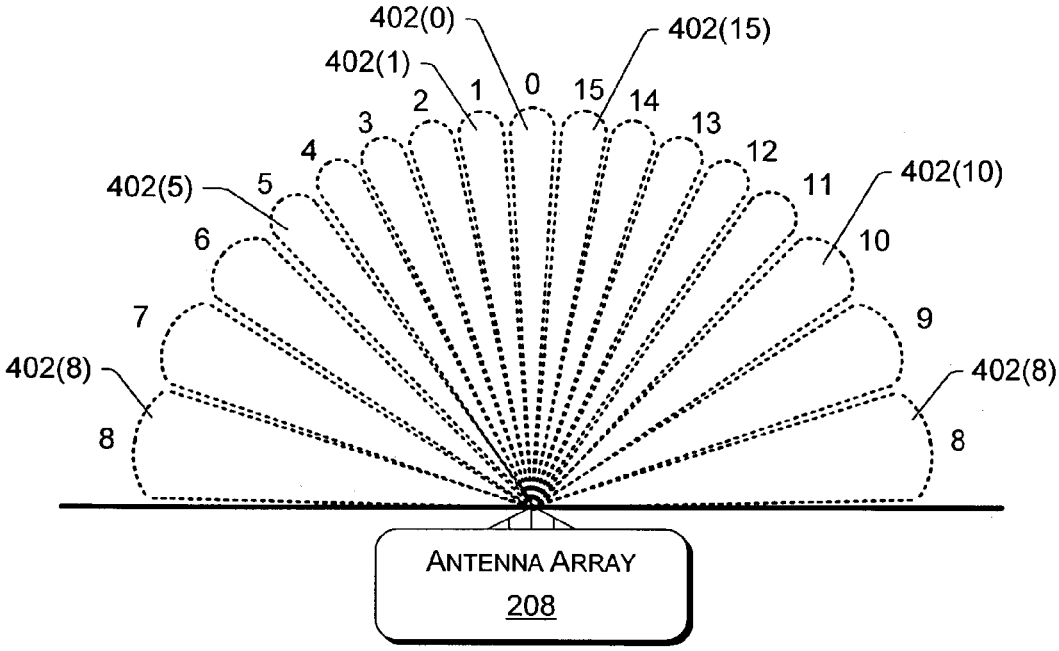
FIG. 4 illustrates an exemplary set of communication beams that emanate from an antenna array as shown in FIG. 3.

FIG. 4 illustrates an exemplary set of communication beams 402 that emanate from the antenna array 208 as shown in FIG. 3. In a described implementation, antenna array 208 includes sixteen antennas 208(0), 208(1). . . 208(14), and 208(15) (as shown in FIG. 3). Also, a Butler matrix 302 (not explicitly shown in FIG. 4) that is coupled to antenna array 208 is of a $16^{th}$ order.

From the sixteen antennas 208(0) . . . 208(15), sixteen different communication beams 402(0) . . . 402(15) are formed as the wireless signals emanating from antennas 208 add and subtract from each other during electromagnetic propagation. Communication beams 402(1) . . . 402(15) spread out symmetrically from the central communication beam 402(0). The narrowest beam is the central beam 402(0), and the beams become wider as they spread outward from the center. For example, beam 402(15) is slightly wider than beam 402(0), and beam 402(5) is wider than beam 402(15). Also, beam 402(10) is wider still than beam 402(5).

The indices 0 . . . 15 for the sixteen different communication beams 402(0) . . . 402(15) may correspond to the indices 0 . . . 15 of the antenna ports of Butler matrix 302 as well as the indices 0 . . . 15 of the TRX ports thereof. However, no single communication beam 402(x) necessarily corresponds to a single antenna port x of Butler matrix 302 because each communication beam 402 is formed from the interplay of electromagnetic radiation with respect to multiple, including all, of the antennas of antenna array 208.

Due to real-world effects of the interactions between and among the wireless signals as they emanate from antenna array 208 (e.g., assuming a linear antenna array in a described implementation), communication beam 402(8) is degenerate such that its beam pattern is formed on both sides of antenna array 208. These real-world effects also account for the increasing widths of the other beams 402(1 . . . 7) and 402(15 . . . 9) as they spread outward from central beam 402(0).

Figure 5:
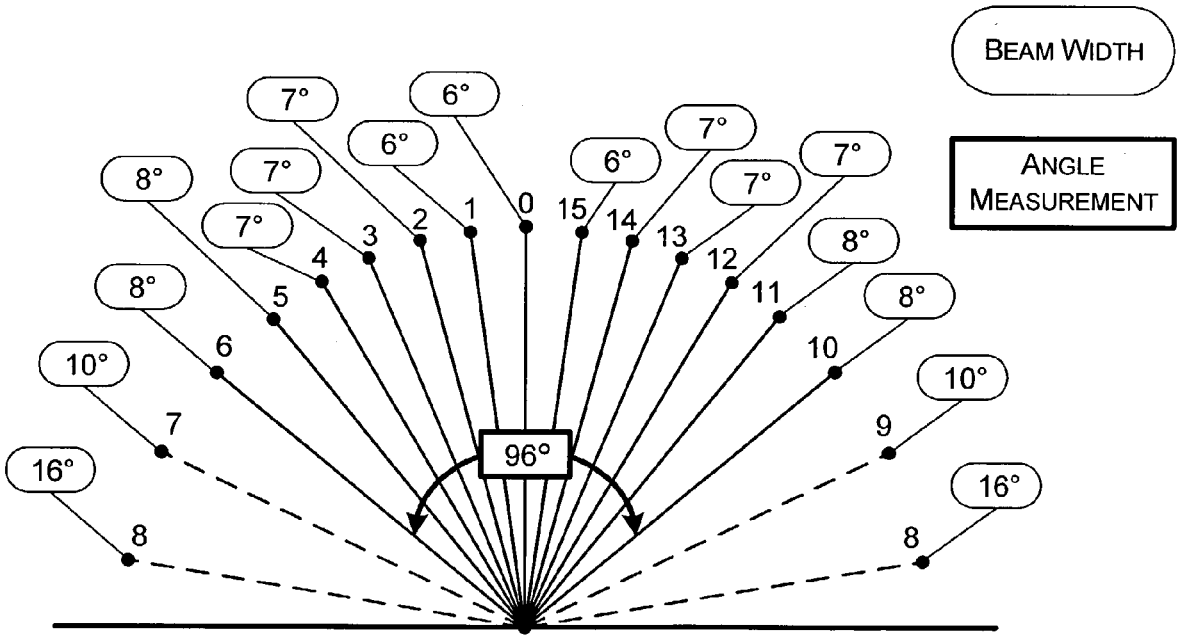
FIG. 5 illustrates exemplary beam widths of the set of communication beams as shown in FIG. 4.

FIG. 5 illustrates exemplary beam widths of the set of sixteen communication beams 402(0 . . . 15) as shown in FIG. 4. The different beams are indicated by the same indices in FIG. 5 as they are in FIG. 4 above. As also noted above, the beam widths of the sixteen different beams 0 . . . 15 increase as the beams diverge from central beam 0. It should be noted that the overall beam pattern may be considered to have seventeen different beams (instead of sixteen different beams) if degenerate beam 8 is counted as two different beams, even though transceived communication signals associated therewith map to a single signal processor (SP) via a single TRX port of a corresponding Butler matrix (not shown in FIG. 5).

The beam widths of the sixteen beams 0 . . . 15 are indicated in degrees within the ovals of FIG. 5. Each of the indicated beam widths are approximate and may be applicable only to this described implementation. By way of example, beam 0 is 6° wide, beam 4 is 7° wide, and beam 9 is 10° wide. The beam widths of the different beams increase in width with a left/right symmetry about the central beam 0. Thus, beams 2 and 14 are both 7° wide, and beams 6 and 10 are both 8° wide. Table 1 also indicates the beam widths in degrees for the sixteen beams 0 . . . 15.

TABLE 1

Exemplary set of sixteen beam widths in degrees.

| Beam Index | Approximate Beam Width |
|---|---|
| 0 | 6° |
| 1 and 15 | 6° |
| 2 and 14 | 7° |
| 3 and 13 | 7° |
| 4 and 12 | 7° |
| 5 and 11 | 8° |
| 6 and 10 | 8° |
| 7 and 9 | 10° |
| 8 | 16° (×2 for both sides) |

In a described implementation, all sixteen beams 0 . . . 15 are not utilized for wireless communications. Specifically, beams 7 and 9 are not used because they 8 are too wide and/or indiscriminate to be sufficiently beneficial. Furthermore, beam 8 is also ignored because its degenerate nature makes it even more difficult for it to be effectively utilized. These unused beams 7, 8, and 9 are indicated by dashed lines in FIG. 5. The effective coverage zone is therefore less than 180°. In this described implementation, the angle measurement of the covered area corresponds to approximately 96°. This 96°, which is indicated in FIG. 5 within a rectangle, reflects an arc between beam 6 and beam 10, as numbered.

An access station 202 (of FIG. 2) that omits/ignores beams 7, 8, and 9 may therefore be placed in a corner of a building or other environment because of the 96° angle of coverage from an antenna array 208. Also, TRX ports 7, 8, and 9 of a Butler matrix (e.g., of FIG. 3) may be depopulated because wireless communications on beams 7, 8, and 9 are not effectuated.

It should be noted that beams 7, 8, and 9 need not be ignored and that the TRX ports 7, 8, and 9 of a Butler matrix 302 may be populated with signal processors (SP) 304 even if the beams 7, 8, and 9 are ignored. Also, if a Butler matrix 302 is of an order other than 16, then different communication beams and possibly a different total number of such communication beams may be ignored for efficiency and/or simplicity reasons when such different communication beams are too indiscriminate and/or too degenerate.

Figure 6:
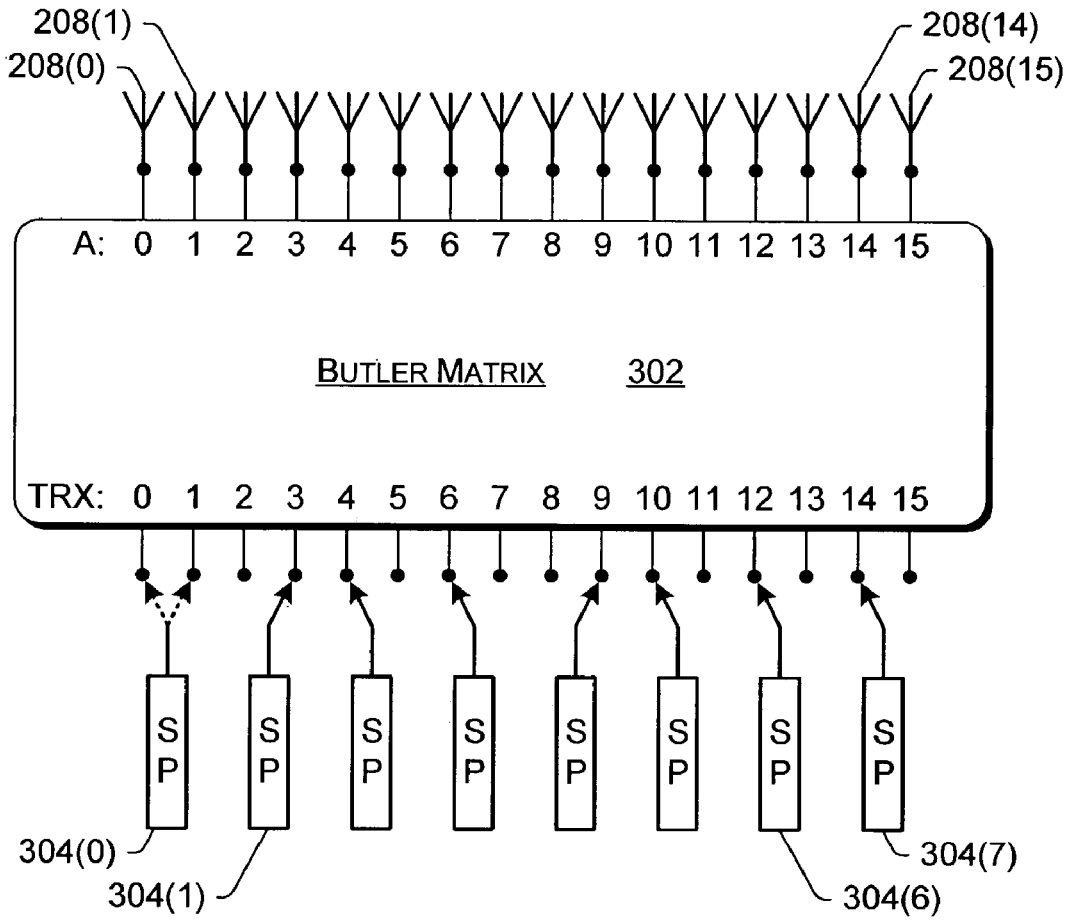
FIG. 6 illustrates an exemplary Butler matrix with multiple transmit/receive (TRX) ports in a depopulated state.

FIG. 6 illustrates an exemplary Butler matrix 302 with multiple transmit and/or receive signal processor (TRX) ports in a depopulated state. Butler matrix 302 is a $16^{th}$ order (e.g., a 16×16) Butler matrix. It has sixteen antenna (A) ports 0 . . . 15 and sixteen TRX ports 0 . . . 15. Each antenna port 0 . . . 15 is coupled to an antenna 208. Thus, every antenna port is coupled to one of the sixteen antennas 208(0 . . . 15). However, each TRX port 0 . . . 15 is not simultaneously coupled to a signal processor (SP) 304. Instead, every two TRX ports are coupled to one of eight signal processors 304(0), 304(1). 304(6), and 304(7).

Specifically, signal processor 304(0) is coupled to TRX port 0 or 1, and signal processor 304(1) is coupled to TRX port 2 or 3. Similarly, signal processor 304(6) is coupled to TRX port 12 or 13, and signal processor 304(7) is coupled to TRX port 14 or 15. Each signal processor 304 is able to switch between being coupled to one of two TRX ports as specifically indicated by the dashed arrows at signal processor 304(0). This switching may be based, for example, on some quality measure. Exemplary approaches and methods for switching between TRX ports based on one or more quality measures are described further below with reference to FIGS. 11 and 12.

By way of example, signal processor 304(0) may transceive communication signals via TRX port 0 or TRX port 1 of Butler matrix 302. When coupled to TRX port 0, signal processor 304(0) "sees" (e.g., is able to transceive wireless communications via) a communication beam 0 that is formed by the combined action/configuration of Butler matrix 302 and antenna array 208. On the other hand, when coupled to TRX port 1, transceiver 304(0) sees a communication beam 1 that is formed by the combined action/configuration of Butler matrix 302 and antenna array 208. Other signal processors 304 may similarly see two different communication beams one beam at a time.

More specifically, for an implementation that is described also with reference to FIG. 5, each signal processor 304 sees approximately twice as many total degrees of coverage as it would if Butler matrix 302 were in a fully populated state, but each signal processor 304 sees the same number of degrees of angular coverage as it would in a fully populated state at any single moment. For example, signal processor 304(0) is switching between TRX ports 0 and 1 and thus between communication beams 0 and 1. Communication beams 0 and 1 are both 6°. Consequently, signal processor 304(0) sees (6+6) or 12° of the total coverage area in angular units of 6° at any single moment.

A single signal processor 304 such as signal processor 304(0) is thus able to see two different antenna beam patterns, such as beams 402(0) and 402(1) (as shown in FIG. 4). Signal processor 304(0) can therefore handle remote clients 104 that are located in either (or both) of beams 402(0) and 402(1). Also, eight signal processors 304(0 . . . 7) can handle remote clients 104 that are located in up to sixteen different beams 402(0. . . 15).

In this described implementation, financial resources can thus be conserved by depopulating half of the TRX ports of a Butler matrix 302. This depopulation precipitates several effects. For example, in addition to switching overhead and/or delays, there is a concomitant reduction in simultaneous signal handling capability at access station 202 (of FIG. 2). However, when wireless communication is effectuated using a packet-based approach, the same total number of remote clients 104 can likely be serviced, even though the total number of remote clients 104 that can be serviced simultaneously decreases by approximately one-half.

Figure 7:
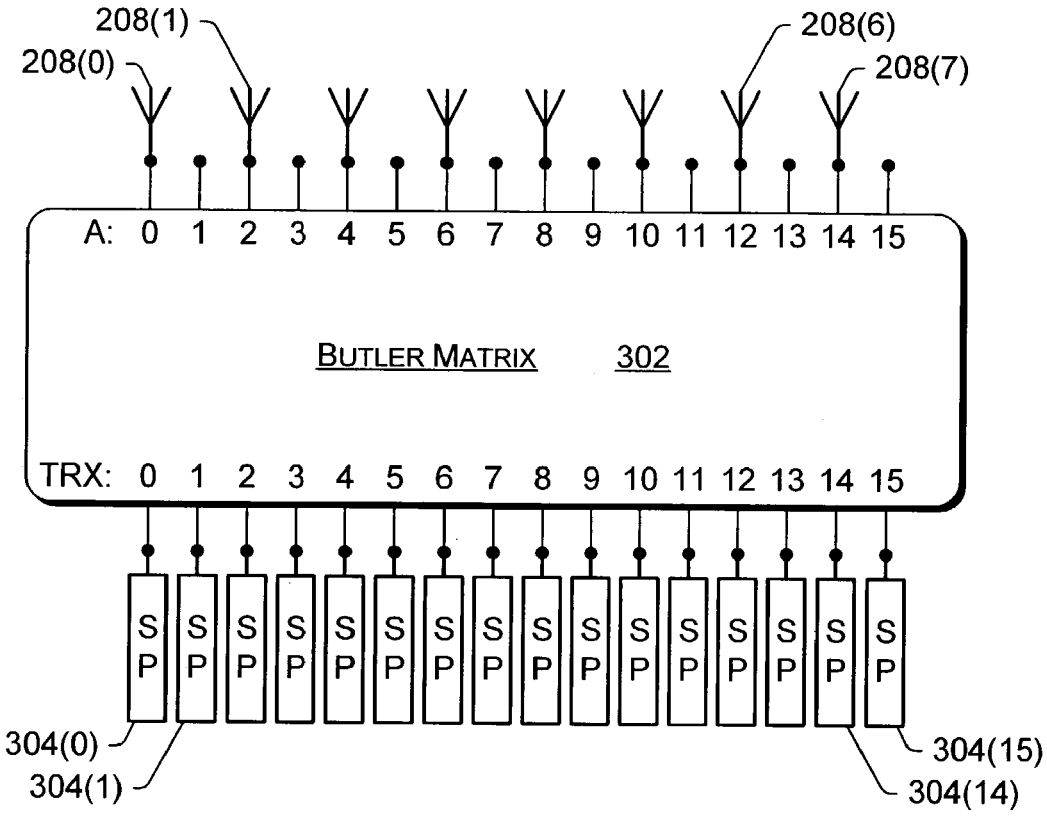
FIG. 7 illustrates an exemplary Butler matrix with multiple antenna ports in a depopulated state.

FIG. 7 illustrates an exemplary Butler matrix 302 with multiple antenna ports in a depopulated state. Butler matrix 302 is a $16^{th}$ order Butler matrix, and it also has sixteen antenna ports 0 . . . 15 and sixteen TRX ports 0 . . . 15. Each TRX port 0 . . . 15 is coupled to a signal processor (SP) 304. Thus, every TRX port is coupled to one of the sixteen signal processors 304(0 . . . 15). However, each antenna port 0 . . . 15 is not coupled to an antenna 208. Instead, every other antenna port of the sixteen antenna ports 0 . . . 15 is coupled to one of eight antennas 208(0), 208(1). 208(6), and 208(7).

Half of the sixteen antenna ports 0 . . . 15 of Butler matrix 302 are thus depopulated and the other half are populated. Specifically, antenna 208(0) is coupled to antenna port 0, and antenna 208(1) is coupled to antenna port 2. Similarly, antenna 208(6) is coupled to antenna port 12, and antenna 208(7) is coupled to antenna port 14. In other words, antennas 208(0 . . . 7) are coupled to antenna ports 0, 2, 4, 6, 8, 10, 12, and 14, respectively, of Butler matrix 302.

Assuming that other spatial parameters are maintained (e.g., that the distance between adjacent antenna elements of antenna array 208 are relatively unchanged), the width of each individual communication beam (not explicitly shown in FIG. 7) that emanates from the combination of Butler matrix 302 and antenna array 208 approximately doubles. In this described implementation, each individual communication beam width is (inversely) related to the maximum spacing between the two antenna elements of the antenna array that are farthest apart. Specifically, an antenna array with twice the maximum spacing has a communication beam width that is half as wide, and vice versa. Consequently, an antenna array with half the antenna elements, with the same inter-element spacing, results in half the maximum antenna array width and therefore a communication beam width that is twice as wide.

In other words, each of the sixteen different communication beams of a half-way populated Butler matrix 302 is approximately twice as wide as it would be if Butler matrix 302 were fully populated. For example, central communication beam 402(0) (of FIG. 4) is approximately 6° wide, but an un-illustrated central communication beam emanating from antenna array 208 of FIG. 7 is approximately 12° wide.

Each of the sixteen signal processors of signal processors 304(0 . . . 15) may elect to effectively see half of one of these sixteen communication beams that are twice as wide as they would be if the sixteen antenna ports 0 . . . 15 of Butler matrix 302 were fully populated. More specifically, each signal processor 304 may actually transceive signals across the entire (e.g., 12° for a central beam) width of the communication beam. However, the beam steering resolution is finer than the beam width. In this case, the beam steering can occur in 6° increments while the beam width is at least 12°.

Hence, as desired and/or as detected from a signal quality perspective, signal processors 304 can elect to transceive over only the central half of each 12°-wide communication beam where the signal power is strongest. If the signal is being transceived to/from a point that is located outside this central portion of a communication beam, then a signal processor 304 (and/or a TRX port) that corresponds to an adjacent beam can assume transceiving responsibilities with respect to the central portion of the adjacent communication beam, especially if the signal quality of the resulting transceived signal is superior in the adjacent communication beam. In other words, the aiming resolution for the different communication beams as seen at the TRX ports of Butler matrix 302 of FIG. 7 is finer than the beam widths of the actual communication beams that emanate from the combination of Butler matrix 302 and antenna array 208 in FIG. 7.

Thus, each signal processor 304 that is connected to a different TRX port of Butler matrix 302 is associated with a different communication beam that is emanating from antennas 208(0 . . . 7). Although each such different communication beam is 12° wide, the respective peaks of the different communication beams may be directionally pointed every 6°. Analogous situations are described further below with particular reference to FIGS. 8–10.

In this described implementation, antenna array cost, size, and complexity can be reduced by depopulating half of the antenna ports of a Butler matrix 302. This depopulation precipitates several effects. For example, although the number of communication beams emanating from the antenna array remains constant, the width of each communication beam doubles and the overlap between communication beams increases. However, the beam steering capability of a related wireless I/O unit 206 maintains the same directionality resolution from the perspective of angular aiming precision for each signal processor 304. In other words, the number of pointing directions to which the communication beams can be aimed does not change.

Figure 8:
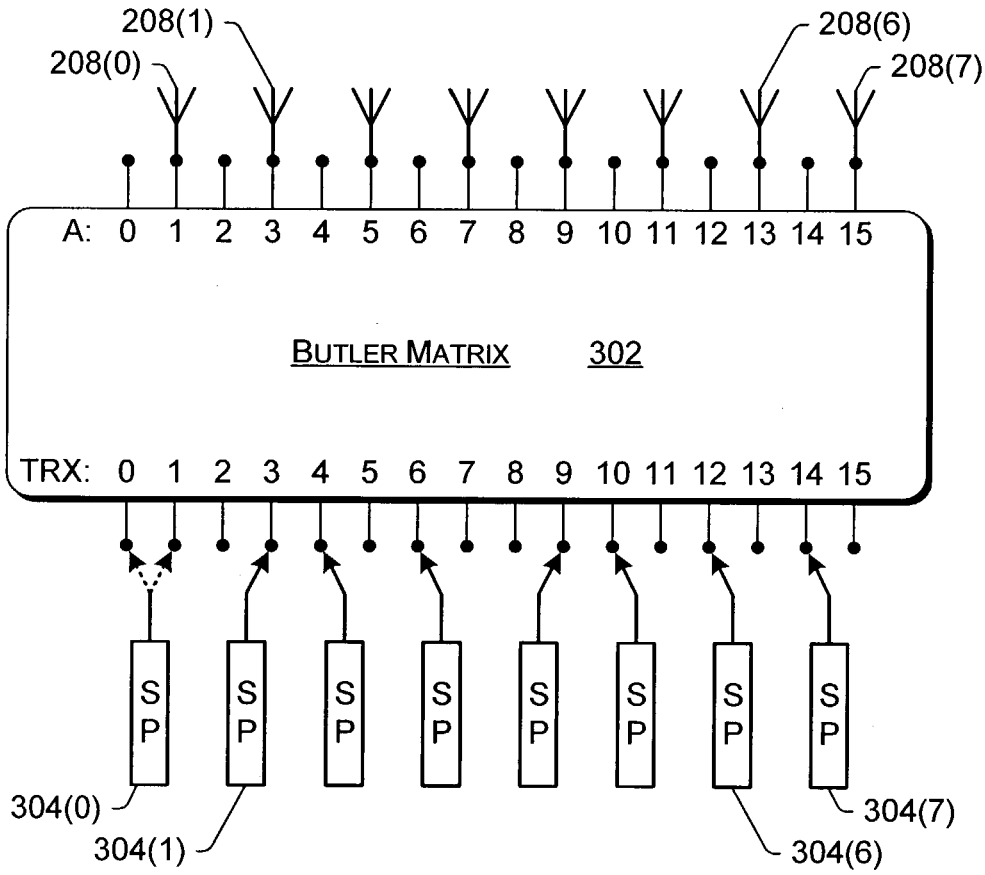
FIG. 8 illustrates an exemplary Butler matrix with both multiple TRX ports in a depopulated state and multiple antenna ports in a depopulated state.

FIG. 8 illustrates an exemplary Butler matrix 302 with both multiple TRX ports in a depopulated state and multiple antenna ports in a depopulated state. Eight antennas 208 are coupled to eight different antenna ports, and eight signal processors (SPs) 304 are coupled to sixteen different TRX ports. Specifically, the eight antennas 208(0), 208(1). . . 208(6), and 208(7) are coupled to the eight antenna ports 1, 3 . . . 13, and 15, respectively. Also, the eight signal processors 304(0), 304(1). . . 304(6), and 304(7) are coupled to the sixteen TRX ports 0/1, 2/3 . . . 12/13, and 14/15, respectively, taken two at time. In a described implementation, it is assumed that the antenna element 208(0 . . . 7) spacing in FIG. 8 is the same as that for antenna array 208 in FIG. 6 and that the linear dimension of the array with half as many elements is one-half that of FIG. 6.

Although the communication beams (not explicitly shown in FIG. 8) that emanate from the eight antennas 208(0 . . . 7) in conjunction with Butler matrix 302 are doubly wide as compared to a fully populated antenna array 208, the steering resolution of communications transceived therewith still corresponds to a fully populated antenna array 208 as seen at the TRX ports 0 . . . 15. This aspect of FIG. 8 is analogous to the Butler matrix permutation of FIG. 7 as described above.

However, an individual signal processor 304 is not assigned to each TRX port full time. Instead, every two TRX ports share a single signal processor 304. Each signal processor 304 switches between being coupled (physically, operationally, and/or functionally) to one of two TRX ports as again indicated by the dashed lines at signal processor 304(0). This aspect of FIG. 8 is analogous to the Butler matrix permutation of FIG. 6 as described above.

The individual effects of depopulating the antenna ports and of depopulating the TRX ports of Butler matrix 302 are thus jointly experienced by the permutation of FIG. 8. For example, signal processor 304(6) sees a first "doubly-wide" communication beam that corresponds to TRX port 12 when coupled thereto, and signal processor 304(6) sees a second "doubly-wide" communication beam that corresponds to TRX port 13 when coupled thereto. However, a distance between the peaks of the first and the second "doubly-wide" communication beam is not doubly-wide. In a described implementation, the first and the second "doubly-wide" communication beams are each 12° wide, but the distance between their peaks is only 6°.

Figure 9:
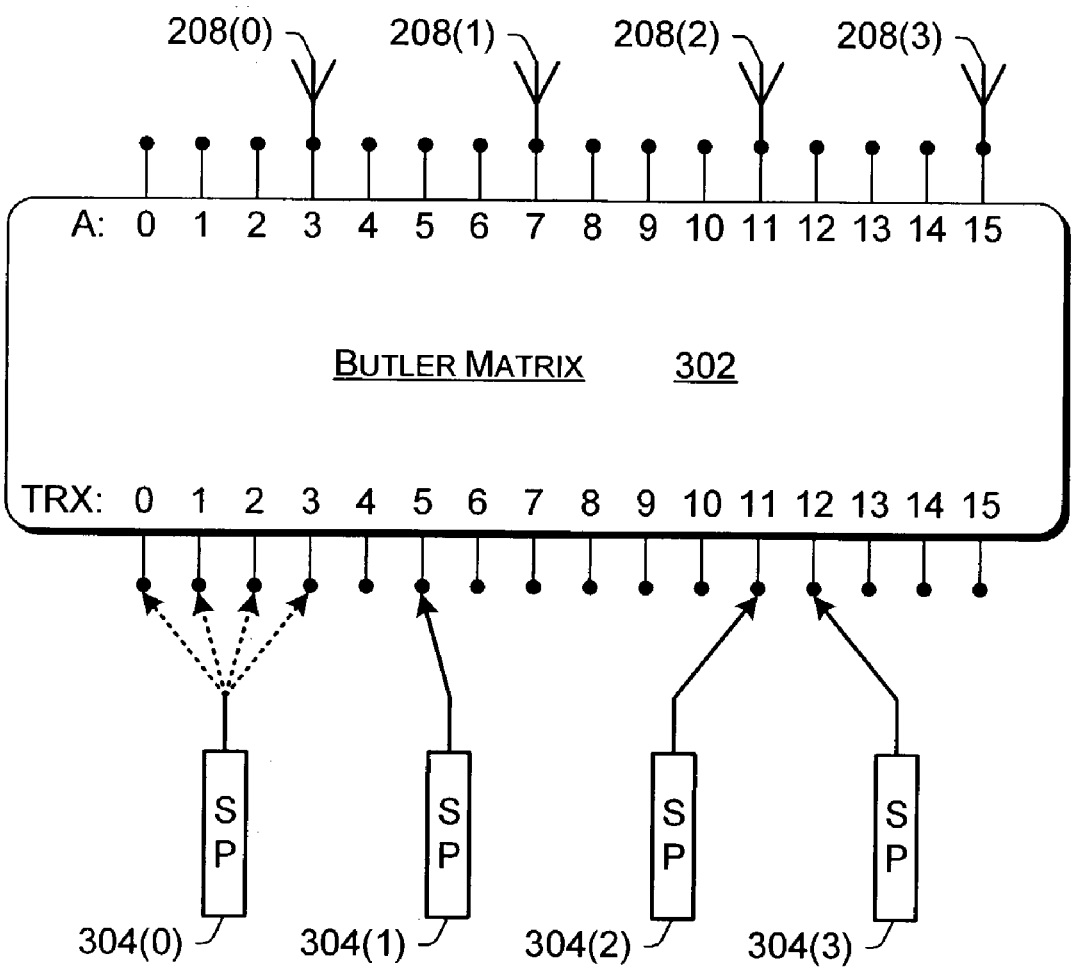
FIG. 9 illustrates another exemplary Butler matrix with both multiple TRX ports in a depopulated state and multiple antenna ports in a depopulated state.

FIG. 9 illustrates another exemplary Butler matrix 302 with both multiple TRX ports in a depopulated state and multiple antenna ports in a depopulated state. Butler matrix 302 is still a $16^{th}$ order Butler matrix with sixteen antenna ports 0 . . . 15 and sixteen TRX ports 0 . . . 15, but it has only four antennas 208(0 . . . 3) and four signal processors 304(0 . . . 3) coupled thereto.

Four antennas 208 are coupled to four different antenna ports, and four signal processors 304 are coupled to sixteen different TRX ports. Specifically, the four antennas 208(0), 208(1), 208(2), and 208(3) are coupled to the four antenna ports 3, 7, 11, and 15, respectively. Also, the four signal processors 304(0), 304(1), 304(2), and 304(3) are coupled to the sixteen TRX ports 0/1/2/3, 4/5/6/7, 8/9/10/11, and 12/13/14/15, respectively, taken four at time.

Each of the communication beams (not explicitly shown in FIG. 9) that emanate from antennas 208 in conjunction with Butler matrix 302 are four times wider than the communication beams that would emanate from sixteen antennas 208 if Butler matrix 302 were fully populated. However, the aiming resolution in angular degrees may be maintained from the perspective of TRX ports 0 . . . 15.

The sixteen TRX ports 0 . . . 15 are coupled to four different signal processors 304(0 . . . 3) such that only four of the sixteen TRX ports 0 . . . 15 are being used to transceive communication signals at any one moment. The particular TRX port of four possible TRX ports to which a given individual signal processor 304 is coupled is effectuated by a switching mechanism that is described further below with reference to FIGS. 11 and 12.

Thus, a wireless I/O unit 206 implementation may include a Butler matrix 302 that has been three-quarters depopulated with respect to either or both of the antenna ports and the TRX ports. It should be noted that other depopulation proportions besides one-half and three-quarters may alternatively be employed. Furthermore, such depopulation proportions need not be related to a power of two even though the complexity of such implementations that do deviate from a power of two consequently increases.

Figure 10:
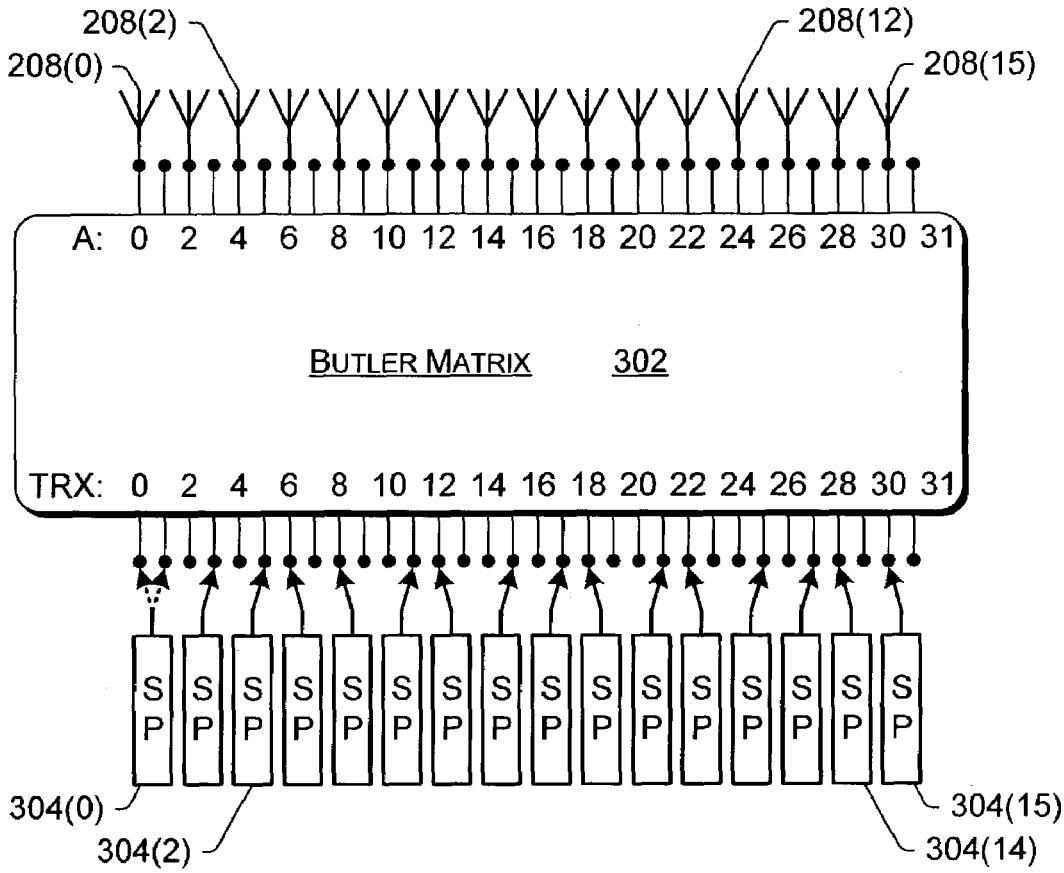
FIG. 10 illustrates yet another exemplary Butler matrix with both multiple TRX ports in a depopulated state and multiple antenna ports in a depopulated state.

FIG. 10 illustrates yet another exemplary Butler matrix 302 with both multiple TRX ports in a depopulated state and multiple antenna ports in a depopulated state. In this permutation, sixteen different antennas 208(0 . . . 15) and sixteen different signal processors 304(0 . . . 15) are coupled to Butler matrix 302 as was also illustrated in FIG. 3. However, Butler matrix 302 in FIG. 10 is of a $32^{nd}$ order (e.g., a 32×32 Butler matrix). It has thirty-two antenna ports 0 . . . 31 and thirty-two TRX ports 0 . . . 31.

Specifically, the sixteen antennas 208(0) . . . 208(2) . . . 208(12) . . . 208(15) are coupled to sixteen antenna ports 0 . . . 4 . . . 24 . . . 30, respectively, of the thirty-two total antenna ports 0 . . . 31. Also, the sixteen signal processors 304(0). 304(2) . . . 304(14), and 304(15) are coupled to the thirty-two TRX ports 0/1 . . . 4/5 . . . 28/29, and 30/31, respectively, taken two at time.

With this permutation, supplanting a passive 16×16 Butler matrix 302 with a passive 32×32 Butler matrix 302 adds little to the cost of a wireless I/O unit 206 (of FIG. 2) while simultaneously augmenting the angular aiming resolution of the covered area. In a described implementation, it is assumed that the physical parameters for antenna array 208 of FIG. 3 and for antenna array 208 of FIG. 10 are similar or analogous. Consequently, each communication beam emanating from either such antenna array 208 is 6° wide. However, the steering resolutions differ between the two configurations.

Specifically, the steering resolution for antenna array 208 of FIG. 3 is 6°. The steering resolution for antenna array 208 of FIG. 10, on the other hand, is 3°. For example, signal processor 304(2) may transceive using a first communication beam that corresponds to TRX port 4 or using a second communication beam that corresponds to TRX port 5. Although each of these first and second communication beams is 6° wide, the angular distance between their peaks is only 3°. Thus, the communication beam steering resolution is finer than the communication beam width. Furthermore, the combination of the sixteen antennas 208(0 . . . 15) and Butler matrix 302 effectively produces thirty-two different communication beams.

Other antenna array 208 and Butler matrix 302 configurations can alternatively be implemented. For example, a sixteen element antenna array 208 like that of FIG. 10 may be coupled to a Butler matrix 302 that is of a $64^{th}$ order. In this case, each resulting communication beam is still 6° wide. However, each resulting communication beam may be steered in increments of 1.5° from the perspective of the TRX ports 0 . . . 63 of such a $64^{th}$ order Butler matrix 302.

The various permutations of FIGS. 6–10 have been described with regard to the implementation illustrated in FIG. 3. As a result, FIGS. 6–9 are described as having a Butler matrix 302 that has antenna and/or TRX ports in a depopulated state. Also, FIG. 10 is described as supplanting a Butler matrix 302 of a first order with a Butler matrix 302 of a second, higher order. It should be understood, however, that (i) depopulating a Butler matrix 302 and (ii) altering the order of a Butler matrix 302 while not increasing the number of antennas or transceivers are analogous and equivalent situations and/or operations. In other words, they may be considered as two sides of the same coin that only appear to differ based on the selection of a relevant initial condition and/or on the selection of a desired terminology.

As alluded to above individually, various Butler matrix port population configurations relate to various effects. Assume that a Butler matrix is fully populated at both its antenna ports and its TRX ports in an original configuration. For a first permutation, the TRX ports of the Butler matrix are depopulated, but the population of the antenna ports is unchanged. In this case, the cost of implementing such a permutation may be decreased by eliminating signal processors. Furthermore, the gain as well as the coverage and range may be maintained at a level comparable to that of the original, fully-populated state. There may be, however, a small performance penalty with respect to the number of remote clients that can be simultaneously serviced.

For a second permutation, the antenna ports of the Butler matrix are depopulated, but the population of the TRX ports is unchanged. In this case, the widths of the multiple communication beams are increased (e.g., doubled), but the signal processors can effectively steer each beam at an angular differential that is less than the beam widths. Thus, the same beam aiming resolution may be maintained because steering directionality is controllable at a resolution that is finer than the beam width.

In a third permutation, neither the antenna ports nor the TRX ports are depopulated, but the order of the Butler matrix is increased. The cost is approximately unchanged because Butler matrices are inexpensive relative to the remaining components of a wireless access station. Although the coverage area remains approximately the same, the gain and the range both increase. This increase can be approximately 40% when the order of a Butler matrix is doubled.

Figure 11:
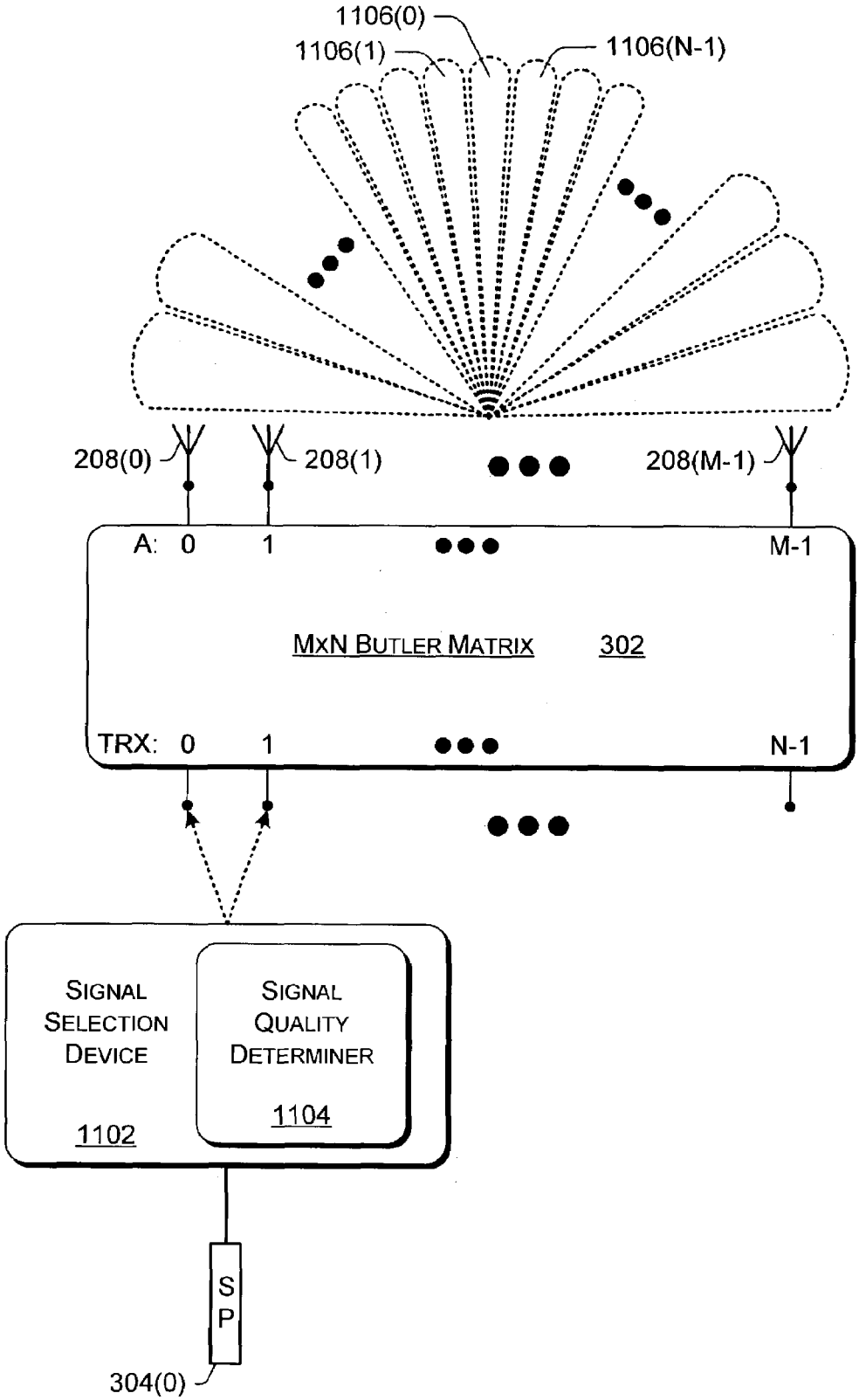
FIG. 11 illustrates a Butler matrix having at least one TRX port in a depopulated state that is coupled to an exemplary signal selection device.

FIG. 11 illustrates a Butler matrix 302 that has at least one TRX port in a depopulated state and that is coupled to an exemplary signal selection device 1102. An M×N order Butler matrix 302 has "M" antenna ports 0 . . . M−1 and "N" TRX ports 0 . . . N−1 in which M and N may be equal or unequal. In this described implementation, each of the M antenna ports 0 . . . M−1 is coupled to one of M antennas 208(0 . . . M−1). However, this description is also applicable to permutations with depopulated antenna ports.

The M antennas 208(0), 208(1) . . . 208(M−1), which together form an antenna array 208, operate in combination with Butler matrix 302 to form multiple communication beams of a communication beam pattern 1106. In a described implementation and as illustrated, antenna array 208 and Butler matrix 302 jointly form N communication beams 1106(0), 1106(1) . . . 1106(N−1). Although not so illustrated, these N communication beams 1106(0 . . . N−1) may form an overall beam pattern identical, similar, and/or analogous to that of FIGS. 4 and 5, depending on the number of antennas 208, the order of Butler matrix 302, and so forth.

Signal processor (SP) 304(0) is indirectly coupled to Butler matrix 302 by way of signal selection device 1102. Signal selection device 1102 selects the TRX port to which signal processor 304(0) should be coupled from among two or more TRX ports of Butler matrix 302. Signal selection device 1102 thus enables one or more signal processors 304 to implement or facilitate one or more kinds of signal selection schemes (e.g., such as those based on diversity) with respect to different communication beams 1106.

In the illustrated implementation, signal selection device 1102 selects from between TRX ports 0 and 1 of Butler matrix 302 for signal processor 304(0) as indicated by the dashed lines. This selection is made responsive to one or more communication signals from remote clients 104 (of FIGS. 1 and 2) that are located in or near communication beam 1106(0) and/or communication beam 1106(1). This selection may be made using signal quality determiner 1104.

Signal quality determiner 1104 determines the signal quality of transceived signals as present at TRX port 0 and TRX port 1. This signal quality may include and/or relate to signal-to-noise ratio (SNR), interference level(s), multi-path variable(s) (e.g., a lowest delay spread), some combination thereof, and so forth. After signal quality determiner 1104 measures or otherwise determines at least one signal quality, signal selection device 1102 may analyze the determined signal quality in order to select the better (or best) TRX port.

In the illustrated implementation, signal selection device 1102 interprets the signal quality to select TRX port 0 or TRX port 1. For example, signal selection device 1102 may select the port having the better signal quality. This signal quality may reflect the better of two versions of a single signal from a single remote client 104, the better of two different signals from two different remote clients 104, the better communication beam 1106 (e.g., communication beam 1106(0) or 1106(1)) for transceiving a single signal from a single remote client 104, and so forth. Both of signal selection device 1102 and signal quality determiner 1104 may be comprised of hardware, software, firmware, some combination thereof, and so forth.

Figure 12:
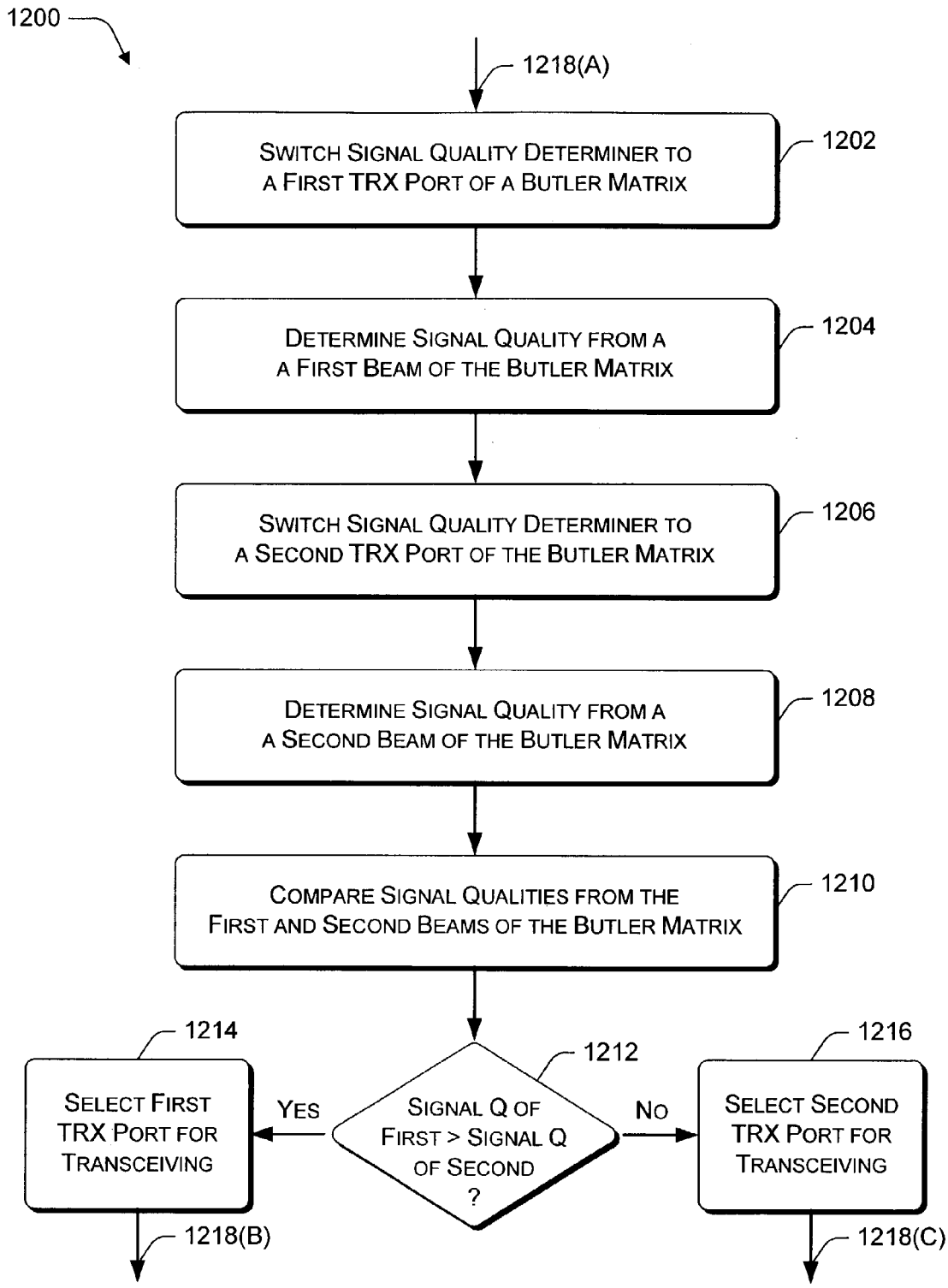
FIG. 12 is a flow diagram that illustrates an exemplary method for using a Butler matrix having a TRX port that is in a depopulated state in conjunction with a signal selection device for transceiving communication signals.

FIG. 12 is a flow diagram 1200 that illustrates an exemplary method for using a Butler matrix having a TRX port that is in a depopulated state in conjunction with a signal selection device for transceiving communication signals. Such a signal selection device may be a separate or an integrated component or feature of an access station; also, such a signal selection device may be a standard or a specialized component or feature of the access station.

Flow diagram 1200 includes eight blocks 1202–1216 that may be implemented with any appropriate hardware, software, firmware, some combination thereof, and so forth and with any appropriate signal selection scheme. However, to improve clarity an exemplary implementation of the method of flow diagram 1200 is described with particular reference to FIG. 11.

It should be noted (i) that the order in which the multiple blocks 1202–1216 are illustrated and/or described is not intended to be construed as a limitation and (ii) that the actions of any number of the described blocks, or portions thereof, can be combined or rearranged in any order to implement one or more methods for improving wireless communication and/or beamforming with Butler matrices.

At block 1202, a signal quality determiner is switched to a first TRX port of a Butler matrix. For example, signal quality determiner 1104 may be switched to TRX port 0 of Butler matrix 302 (of FIG. 11). At block 1204, a signal quality from a first beam of the Butler matrix (in conjunction with an antenna array that is coupled thereto) is determined. For example, a first signal quality of a signal that is being transmitted or received within or proximate to communication beam 1106(0) is determined using signal quality determiner 1104.

At block 1206, the signal quality determiner is switched to a second TRX port of the Butler matrix. For example, signal quality determiner 1104 may be switched to TRX port 1 of Butler matrix 302. At block 1208, a signal quality from a second beam of the Butler matrix (in conjunction with the antenna array that is coupled thereto) is determined. For example, a second signal quality of a signal that is being transmitted or received within or proximate to communication beam 1106(1) is determined using signal quality determiner 1104. The determined first and second signal qualities may relate to the same signal with respect to the different communication beams 1106(1) and 1106(2), to different versions of the same signal, to different signals, and so forth.

At block 1210, the signal quality from the first beam of the Butler matrix is compared to the signal quality from the second beam of the Butler matrix. For example, signal selection device 1102 may compare the first signal quality that is related to communication beam 1106(0) to the second signal quality that is related to communication beam 1106 (1). At block 1212, it is determined from the comparison whether the signal quality from the first beam of the Butler matrix is greater than the signal quality from the second beam of the Butler matrix. This determination may be accomplished, for example, by signal selection device 1102 determining a greater of two values for SNR, for interference level(s), for multi-path variable(s), some combination thereof, and so forth.

If the signal quality from the first beam of the Butler matrix is greater than the signal quality from the second beam of the Butler matrix (as determined at block 1212), then the first TRX port of the Butler matrix is selected for transceiving at block 1214. For example, signal selection device 1102 may couple signal processor 304(0) to TRX port 0 of Butler matrix 302. If, on the other hand, the signal quality from the first beam of the Butler matrix is not determined to be greater than the signal quality from the second beam of the Butler matrix, then the second TRX port of the Butler matrix is selected for transceiving at block 1216. For example, signal selection device 1102 may couple signal processor 304(0) to TRX port 1 of Butler matrix 302.

In a described implementation, the actions of the eight (8) blocks 1202–1216 are performed when at least one signal is present at one or more TRX ports. Any of many possible schemes may be implemented between the arrival of signals and/or for detecting a signal, as indicated by arrows 1218 (A), 1218(B), and 1218(C). For example, a signal quality may be measured on each TRX port until a signal is detected. The signal quality for the detected signal is then determined on at least two TRX ports (and possibly over all TRX ports) to determine the better or best TRX port for receiving the signal. That better or best TRX port is then used for that signal until the transmission ceases, or until another signal quality measuring across multiple TRX ports is warranted (e.g., because of signal quality degradation, a timer expiration, etc.). The signal quality measuring/detecting may then continue and/or may also be continuing while the actions of flow diagram 1200 are occurring.

The implementations described hereinabove and illustrated in FIGS. 3 and 6–12 focus on a Butler matrix as an exemplary passive beamformer. However, other realizations for a passive beamformer may alternatively be used. For example, in addition to a Butler matrix, a passive beamformer may be implemented as a Rotman lens, a canonical beamformer, a lumped-element beamformer with static or variable inductors and capacitors, and so forth. For instance, a first Rotman lens with "x" TRX ports and "y" antenna ports can be substituted with a second Rotman lens with "x+w" (where w is positive) TRX ports to achieve a finer beam aiming resolution.

Although methods, systems, apparatuses, arrangements, schemes, approaches, and other implementations have been described in language specific to structural and functional features and/or flow diagrams, it is to be understood that the invention defined in the appended claims is not necessarily limited to the specific features or flow diagrams described. Rather, the specific features and flow diagrams are disclosed as exemplary forms of implementing the claimed invention.

The invention claimed is:

1. An access station for wireless communications, the access station comprising:

a Butler matrix having a plurality of antenna ports and a plurality of transmit and/or receive (TRX) ports, a first TRX port of the plurality of TRX ports corresponding to a first communication beam and a second TRX port of the plurality of TRX ports corresponding to a second communication beam wherein at least one antenna port of the plurality of antenna ports is not populated with an antenna and at least four TRX ports of the plurality of TRX ports are not populated with signal processors;

a signal processor; and a signal selection device that is capable of coupling the signal processor to the first TRX port of the plurality of TRX ports or to the second TRX port of the plurality of TRX ports responsive to at least one signal quality determination made on a first wireless communication associated with the first communication beam and a second wireless communication associated with the second communication beam.

2. The access station as recited in claim 1, wherein the signal selection device further comprises a signal quality determiner that is capable of measuring the at least one signal quality, the at least one signal quality pertaining to wireless communication of one or more signals in a beamforming environment.

3. The access station as recited in claim 1, wherein the at least one signal quality relates to at least one of a signal-to-noise ratio (SNR), an interference level, and a multi-path variable.

4. The access station as recited in claim 1, further comprising:

a plurality of antennas forming an antenna array, the plurality of antennas coupled to a portion of the plurality of antenna ports of the Butler matrix;

wherein the antenna array and the Butler matrix jointly form the first communication beam and the second communication beam.

5. The access station as recited in claim 1, further comprising:

an antenna array coupled to the Butler matrix at the plurality of antenna ports;

wherein the first communication beam points in a first angular direction and the second communication beam points in a second angular direction.

6. A Butler matrix for beamforming at an access station in a wireless communications environment, the Butler matrix comprising:

a plurality of antenna ports; and a plurality of transmit and/or receive (TRX) ports;

wherein a plurality of ports are in a depopulated state during operation, and the plurality of ports that are in a depopulated state during operation comprises at least half of the plurality of antenna ports and at least half of the plurality of TRX ports.

7. An access station for wireless communications, the access station comprising:

a Butler matrix having "M" antenna ports and "N" transmit and/or receive (TRX) ports; and at least one antenna that is coupled to at least one antenna port of the "M" antenna ports;

wherein at least "M/2" of the "M" antenna ports and at least "N/2" of the "N" TRX ports are depopulated.

8. The access station as recited in claim 7, wherein "M" is equal to "N".

9. The access station as recited in claim 8, wherein "M" and "N" are equal to one of 4, 8, 16, 32, and 64.

10. The access station as recited in claim 7, wherein the access station is capable of operating in accordance with an IEEE 802.11 standard.

11. The access station as recited in claim 7, further comprising:

a plurality of antennas that are coupled to at least a portion of the "M" antenna ports; and a plurality of signal processors that are coupled to at least a portion of the "N" TRX ports.

12. The access station as recited in claim 7, further comprising:

a phased array antenna that is operatively coupled to the Butler matrix;

a plurality of signal processors that are operatively coupled to the Butler matrix; and at least one baseband processor in communication with at least one of the plurality of signal processors for handling transceived wireless signals.

13. An access station for wireless communications, the access station comprising:

a Butler matrix having "M" antenna ports and "N" transmit and/or receive (TRX) ports;

wherein at least "M/2" of the "M" antenna ports are depopulated;

wherein "M" is equal to "N"; and wherein "M" and "N" are a multiple of two.

14. An access station for wireless communications, the access station comprising:

a Butler matrix having "M" antenna ports and "N" transmit and/or receive (TRX) ports;

wherein a plurality of the "N" TRX ports and a plurality of the "M" antenna ports are depopulated; and wherein the plurality of the "N" TRX ports that are depopulated is equal to at least "N/2", and the plurality of the "M" antenna ports that are depopulated is equal to at least "M/2".

15. An access station for wireless communications, the access station comprising:

a Butler matrix having "M" antenna ports and "N" transmit and/or receive (TRX) ports;

wherein (i) a plurality of the "M" antenna ports and (ii) a plurality of the "N" TRX ports are depopulated; and a plurality of signal processors;

wherein the plurality of signal processors are coupled to every other TRX port of at least a subset of the "N" TRX ports.

16. An access station for wireless communications, the access station comprising:

a Butler matrix having a plurality of antenna ports and a plurality of transmit and/or receive (TRX) ports, at least half of both the plurality of antenna ports and the plurality of TRX ports being depopulated at any given moment;

a signal processor; and a signal selection device that is capable of coupling the signal processor to multiple TRX ports of the plurality of TRX ports responsive to a signal quality determination, the signal selection device adapted to switch the signal processor from a first TRX port of the multiple TRX ports to a second TRX port of the multiple TRX ports.

17. The access station as recited in claim 16, wherein the signal processor is capable of processing signals during at least one of transmission and reception.

18. The access station as recited in claim 16, wherein the signal selection device comprises at least one of hardware, software, and firmware.

19. The access station as recited in claim 16, wherein the access station comprises at least one of a nexus point, a trunking radio, a base station, a wireless local area network/wide area network (LAN/WAN) (Wi-Fi) switch, and an access point.

20. The access station as recited in claim 16, wherein the second TRX port of the multiple TRX ports is in a depopulated state immediately preceding the switch of the signal processor to the second TRX port of the multiple TRX ports from the first TRX port of the multiple TRX ports by the signal selection device.

21. The access station as recited in claim 16, wherein the signal quality determination relates to at least one of a signal-to-noise ratio (SNR), an interference level, and a multi-path variable.

22. An access station for wireless communications, the access station comprising:

a Butler matrix having a plurality of antenna ports and a plurality of transmit and/or receive (TRX) ports, at least one antenna port of the plurality of antenna ports and at least four TRX ports of the plurality of TRX ports unpopulated; and an antenna array having a plurality of antenna elements that are coupled to a portion of the plurality of antenna ports of the Butler matrix;

wherein signals that are applied to the plurality of TRX ports of the Butler matrix are transceived on a plurality of communication beams that are formed jointly by the Butler matrix and the antenna array, and wherein the access station is adapted to have an aiming resolution for communication beams of the plurality of communication beams that is finer than a width of a narrowest communication beam of the plurality of communication beams.

23. An arrangement for wireless communication and beamforming, the arrangement comprising:

matrix means for phase adjusting and routing signals between a plurality of antenna ports and a plurality of transmit and/or receive (TRX) ports, at least half of the plurality of antenna ports and at least half of the plurality of TRX ports unpopulated;

antenna array means for transceiving as wireless communications signals accepted from up to half of the plurality of antenna ports of the matrix means;

processing means for processing signals during transmission and/or reception; and signal selection means for switching the processing means from one TRX port to another TRX port of the plurality of TRX ports of the matrix means.

24. The arrangement as recited in claim 23, wherein the signal selection means includes signal quality determining means for determining at least one signal quality from signals accessible at one or more TRX ports of the plurality of TRX ports of the matrix means; and wherein the signal selection means switches the processing means from one TRX port to another TRX port responsive to the at least one signal quality as determined by the signal quality determining means.

25. A method for an access station, the method comprising the actions of:

comparing a first signal quality from a first communication beam to a second signal quality from a second communication beam;

if the first signal quality is greater than the second signal quality, then transceiving from a first transmit and/or receive (TRX) port of a Butler matrix; and if the second signal quality is greater than the first signal quality, then transceiving from a second TRX port of the Butler matrix;

wherein the first communication beam and the second communication beam are adjacent communication beams; and wherein a width of each of the first communication beam and the second communication beam is equal to approximately twice a distance between a peak of the first communication beam and a peak of the second communication beam; and wherein the Butler matrix includes a plurality of TRX ports and a plurality of antenna ports with at least half of both the plurality of antenna ports and the plurality of TRX ports being unpopulated at any given moment.

26. The method for an access station as recited in claim 25, wherein the action of transceiving from a first TRX port of a Butler matrix comprises the action of coupling a signal processor to the first TRX port of the Butler matrix; and wherein the action of transceiving from a second TRX port of the Butler matrix comprises the action of coupling the signal processor to the second TRX port of the Butler matrix.

27. The method for an access station as recited in claim 25, further comprising the actions of:

measuring the first signal quality from a first wireless communication as seen at the first TRX port of the Butler matrix; and measuring the second signal quality from a second wireless communication as seen at the second TRX port of the Butler matrix.

28. The method for an access station as recited in claim 25, further comprising the actions of:

forming the first communication beam using the Butler matrix and an antenna array that is coupled thereto; and forming the second communication beam using the Butler matrix and the antenna array that is coupled thereto.

29. An access station that is configured to perform actions comprising:

transceiving signals on a first communication beam via a first transmit and/or receive (TRX) port of a Butler matrix; and transceiving signals on a second communication beam via a second TRX port of the Butler matrix;

wherein the first communication beam and the second communication beam are adjacent communication beams, and wherein a distance between a peak of the first communication beam and a peak of the second communication beam is approximately half of a width of the first communication beam;

wherein the access station comprises a plurality of signal processors; and wherein the Butler matrix includes at least four TRX ports with the plurality of signal processors coupled at any given moment to every other TRX port of at least a subset of the at least four TRX ports of the Butler matrix.

30. The access station as recited in claim 29, wherein the actions of transceiving signals on a first communication beam and transceiving signals on a second communication beam each also comprise the action of transceiving signals using a plurality of antennas of an array of antennas that is coupled to the Butler matrix.

31. An access station that is configured to perform actions comprising:

determining via a first transmit and/or receive (TRX) port of a Butler matrix a first signal quality at a first communication beam that is emanating from an antenna array coupled to the Butler matrix;

determining via a second TRX port of the Butler matrix a second signal quality at a second communication beam that is emanating from the antenna array coupled to the Butler matrix, the second communication beam overlapping the first communication beam by at least approximately half a communication beam width;

comparing the first signal quality to the second signal quality;

determining from the comparing action whether the first signal quality is superior to the second signal quality; and if so, selecting the first TRX port of the Butler matrix for transceiving wireless communications on the first communication beam;

wherein the Butler matrix includes a plurality of TRX ports and a plurality of antenna ports with at least half of both the plurality of antenna ports and the plurality of TRX ports being unpopulated at any given moment.

32. The access station as recited in claim 31, wherein the access station is configured to perform a further action comprising:

if the first signal quality is not determined to be superior to the second signal quality, selecting the second TRX port of the Butler matrix for transceiving wireless communications on the second communication beam.

33. The access station as recited in claim 31, wherein the action of selecting the first TRX port of the Butler matrix comprises the action of:

coupling a signal processor to the first TRX port of the Butler matrix.

34. The access station as recited in claim 31, wherein the access station is configured to perform a further action comprising:

prior to the action of determining via a second TRX part of the Butler matrix a second signal quality at a second communication beam that is emanating from the antenna array of the Butler matrix, switching a signal processor from the first TRX port of the Butler matrix to the second TRX port of the Butler matrix.

35. The access station as recited in claim 31, wherein the first communication beam is wider than the second communication beam due to real-world electromagnetic effects.

36. The access station as recited in claim 31, wherein the first signal quality and the second signal quality reflect signal qualities of at least one of (i) two different signals and (ii) two different versions of the same signal.

37. An access station for wireless communications, the access station comprising:

a passive beamformer having a plurality of antenna ports and a plurality of transmit and/or receive (TRX) ports, a first TRX port of the plurality of TRX ports corresponding to a first communication beam and a second TRX port of the plurality of TRX ports corresponding to a second communication beam, wherein at least half of the plurality of antenna ports and at least half of the plurality of TRX ports are unpopulated;

a signal processor; and a signal selection device that is capable of coupling the signal processor to the first TRX port of the plurality of TRX ports or to the second TRX port of the plurality of TRX ports responsive to at least one signal quality determination made on a first wireless communication associated with the first communication beam and a second wireless communication associated with the second communication beam.

38. An access station for wireless communications, the access station comprising:

a passive beamformer having a plurality of antenna ports and a plurality of transmit and/or receive (TRX) ports, at least one antenna port of the plurality of antenna ports and at least four TRX ports of the plurality of TRX ports unpopulated; and an antenna array having a plurality of antenna elements that are coupled to a portion of the plurality of antenna ports of the passive beamformer, the plurality of TRX ports numbering more than the plurality of antenna elements;

wherein signals that are applied to the plurality of TRX ports of the passive beamformer are transceived on a plurality of communication beams that are formed jointly by the passive beamformer and the antenna array, and wherein the access station is adapted to have an aiming resolution for communication beams of the plurality of communication beams that is finer than a width of a narrowest communication beam of the plurality of communication beams.

39. An access station that is configured to perform actions comprising:

determining via a first transmit and/or receive (TRX) port of a passive beamformer a first signal quality at a first communication beam that is emanating from an antenna array coupled to the passive beamformer;

determining via a second TRX port of the passive beamformer a second signal quality at a second communication beam that is emanating from the antenna array coupled to the passive beamformer;

comparing the first signal quality to the second signal quality;

determining from the comparing action whether the first signal quality is superior to the second signal quality; and if so, selecting the first TRX port of the passive beamformer for transceiving wireless communications on the first communication beam;

wherein the passive beamformer includes a plurality of TRX ports and a plurality of antenna ports with at least half of both the plurality of antenna ports and the plurality of TRX ports being unpopulated at any given moment.

* * * * *